United States Patent [19]

Olsson

[11] Patent Number: 5,005,511

[45] Date of Patent: Apr. 9, 1991

[54] AIR-DRIVEN LOW-FREQUENCY SOUND GENERATOR WITH POSITIVE FEEDBACK SYSTEM

[75] Inventor: Mats A. Olsson, Bromma, Sweden

[73] Assignee: Infrasonik AB, Stockholm, Sweden

[21] Appl. No.: 424,206

[22] PCT Filed: Apr. 8, 1988

[86] PCT No.: PCT/SE88/00172

§ 371 Date: Oct. 6, 1989

§ 102(e) Date: Oct. 6, 1989

[87] PCT Pub. No.: WO88/07894

PCT Pub. Date: Oct. 20, 1988

[30] Foreign Application Priority Data

Apr. 8, 1987 [SE] Sweden ..... 8701461

[51] Int. Cl.[5] ..... B06B 1/00

[52] U.S. Cl. ..... 116/137 R

[58] Field of Search ..... 116/137 R; 122/379, 122/396; 181/0.5

[56] References Cited

U.S. PATENT DOCUMENTS

| | | | |
|---|---|---|---|
| 4,020,693 | 5/1977 | Ahlgren et al. | 116/137 R |
| 4,359,962 | 11/1982 | Olsson et al. | 116/137 R |
| 4,517,915 | 5/1985 | Olsson et al. | 116/137 R |

FOREIGN PATENT DOCUMENTS

| | | | |
|---|---|---|---|
| 6833 | 9/1983 | European Pat. Off. | 116/137 R |
| 496622 | 4/1930 | Fed. Rep. of Germany | 116/142 FP |
| 577517 | 6/1933 | Fed. Rep. of Germany . | |
| 138532 | 2/1920 | United Kingdom | 116/142 FP |
| 1025549 | 4/1966 | United Kingdom | 116/142 FP |

*Primary Examiner*—William A. Cuchlinski, Jr.
*Assistant Examiner*—W. Morris Worth
*Attorney, Agent, or Firm*—Finnegan, Henderson, Farabow, Garrett & Dunner

[57] ABSTRACT

Air-driven, low-frequency sound generator with a positive feedback system, comprising, as a sound emitter, an open resonator (11) for the generation of standing gas-borne sound waves which produce a varying gas pressure inside the resonator; and feeder (10) with a tube (14) for the supply of pressure gas to the resonator and a back and forth movable springing valve slide (15) whose position remains unaffected by the pressure gas and which regulates the gas flow from the tube while creating a modulated flow of pressure to the resonator. The tube is surrounded by a surge tank (13), connected to the pressure gas source, and the valve slide is arranged as a piston movable inside the tube and is set to regulate a connecting opening (20) between the surge tank and the inside of the tube. This opening is situated at one end surface (19) of the piston and said end surface is being exposed to the inside of the resonator by means of the one end of the tube communicating therewith.

4 Claims, 3 Drawing Sheets

AIR-DRIVEN LOW-FREQUENCY SOUND GENERATOR WITH POSITIVE FEEDBACK SYSTEM

BACKGROUND OF THE INVENTION

The invention relates to an air-driven low-frequency sound generator provided with a system for positive feedback.

A low-frequency sound generator with a positive feedback system is described in EP, A, No. 0 006 833, comprising, as a sound emitter, an open resonator for generating standing gas-borne sound waves which produce a varying gas pressure in the resonator; and a feeder having a pipe for the supply of pressure gas to the resonator and a movable resilient valve slide whose position remains unaffected by the pressure gas and which regulates the gas flow from the pipe while creating a modulated flow of pressure gas to the resonator. Thus the valve slide is connected to a sound-actuated diaphragm mounted inside the resonator. The valve slide is a sleeve-type slide which is axially and displaceably guided inside or outside of the pipe. The pipe is connected to a pressure gas source and the purpose of the valve slide is to control an opening in the pipe-wall for the supply of pressure gas.

The basic principle for the operation of the above described low-frequency generator is: when the sound pressure inside the resonator is higher than the surrounding atmospheric pressure, the valve slide will move in such a direction to free the opening and air having a higher pressure than the sound pressure will then be fed into the resonator. Accordingly, when the sound pressure inside the resonator is lower than the surrounding atmospheric pressure, the valve slide will be forced to move in the opposite direction with the result that the opening is closed.

SUMMARY OF THE INVENTION

In a feeder forming a part of the sound generator, working according to the above described principle, it is essential to supply a large volume of air through the opening during a very short period of time and with a minimum loss of pressure while the air is transported into the resonator. According to the invention, this is achieved in a low-frequency sound generator with a positive feedback system, that includes, as a sound emitter, an open resonator for generating standing, gas-borne sound waves which produce varying gas pressure in the resonator and a feeder connected to one end of the resonator for regulating and supplying pressurized gas to the resonator and in which the feeder comprises a tube open at one end that communicates with the interior of the resonator and a reciprocable, resilient slide valve located in the tube that regulates the flow of pressurized gas from the feeder to the resonator while creating a modulated flow of gas to the resonator, by providing the improvement comprising a surge tank surrounding said tube that is connectable to a source of pressurized gas, a piston slidably mounted in the tube and having a first end surface communicating with the interior of the resonator and spring means acting on its opposite end, said piston being moveable back and forth inside said tube under the competing influences of variations in the pressure inside the resonator and the force of the spring means and an opening in the tube controlled by the piston that communicates the interior of the surge tank with the interior of the tube and the interior of the resonator, said piston periodically opening and closing said opening as it moves back and forth in the tube to thereby modulate the flow of gas to the resonator.

BRIEF DESCRIPTION OF THE DRAWINGS

For a more detailed explanation of the invention, reference is made to the accompanying drawings, wherein.

DESCRIPTION OF PREFERRED EMBODIMENT

Figure 4:
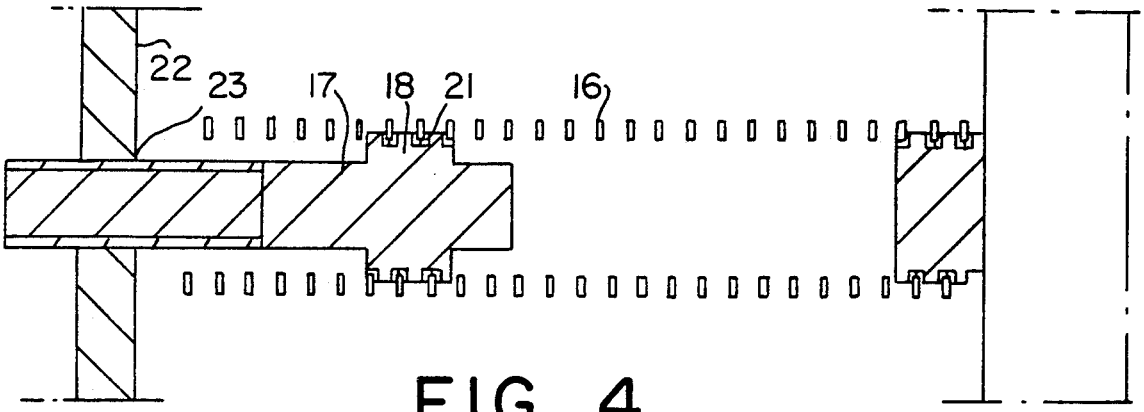
FIG. 4 is an enlarged detail view of the vertical cross-section shown in FIG. 1.
Figure 1:
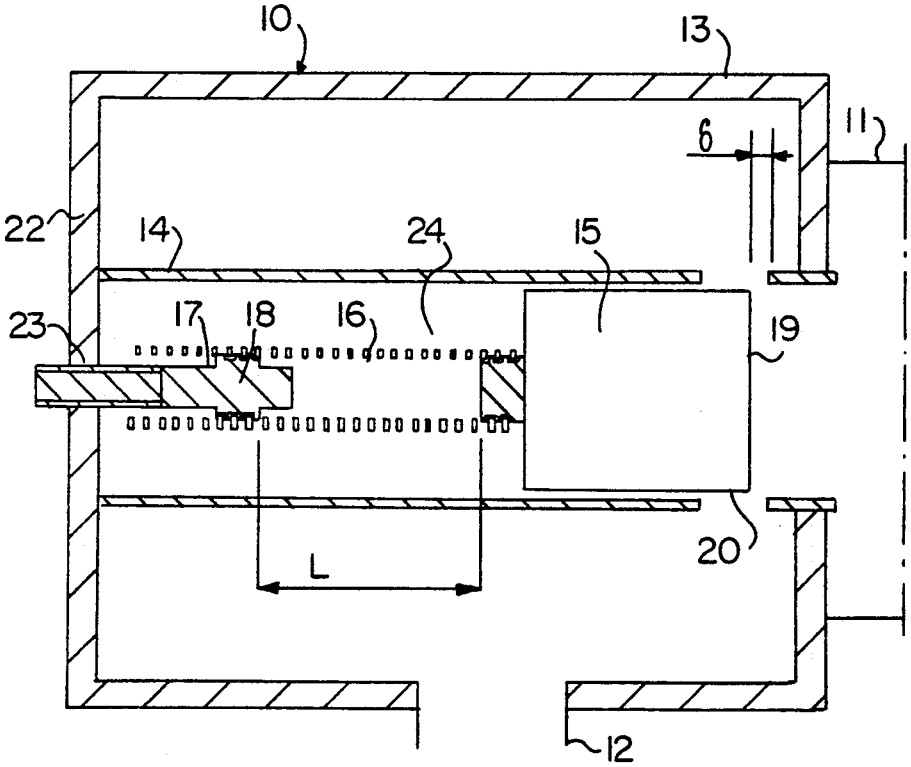
FIG. 1 is a schematic vertical cross-section of a feeder, according to the invention, shown in its rest position.

FIG. 1 shows a feeder 10 connected to a resonator tube 11 (only partly shown). Air from a blower or another high-pressure source (pressure gas source) is supplied to the feeder through the connection inlet 12 and is transported into a surge tank 13 surrounding a circular tube 14 placed in the centre of the feeder. Inside this tube 14 there is a piston 15 which is movable back and forth with low friction due to a small radial play between the piston and the tube. On one of the end surfaces of the piston, a helical spring 16 is mounted at one of its ends, while its other end is connected to a screw spindle 17 by means of a spring retaining socket 18. The end surface 19 of the piston 15 facing the resonator tube 11 delimits a gap with the width $\partial$ at the edge of an opening 20 in the tube 14, and through which the interior of the tube 14 and thereby also the interior of the resonator tube 11 communicates with the interior of the surge tank 13. From FIG. 4, it is evident that the spring retaining socket has an external thread 21, which can be screwed inside the spring 16 and thereby the free length, indicated with an L in FIG. 1, of the spring can be varied. Screw spindle 17 is in engagement with the sidewall 22 of the surge tank 13 by means of a screw thread 23 having the same pitch as the thread of the spring retaining socket 18 so that, the free length of the spring can be adjusted by rotating the screw spindle 17 and without causing any alteration of the gap width $\partial$.

Inside the resonator tube 11, a standing sound wave is generated, having its maximum sound pressure amplitude where the feeder is situated. This sound pressure works on the end surface 19 of the piston, resulting in a force acting upon the piston; said force being equal to the sound pressure multiplied by the area of the end surface. This force, having varying magnitude and direction, results in a reciprocating movement of the piston 15. The piston can move in phase with the variations in sound pressure, only under the condition that the resonance frequency of the oscillating mechanical system is higher than the frequency of the standing sound wave in the resonator tube 11. The resonance frequency is a function of the mass of the piston 15 and approximately a third of the mass of the spring 16, and the spring constant of the spring together with the spring action of the air, being inside the tube 14 and behind the piston.

Sound generators of the type described here, are among other designs used for cleaning big boilers. The open end of the sound generator is connected to a corresponding opening in the wall of the boiler. The air column inside the resonance tube may, in certain cases, obtain a temperature that substantially exceeds the temperature of the air driving the feeder. The sound frequency of the standing sound wave inside the resonator tube, is directly proportional to the propagation rate of the sound in the media, which in turn is directly proportional to the square root of the absolute temperature of the media. Therefore, to obtain optimum functioning, it is desirable to be able to vary the resonance frequency of the oscillating system in the feeder. This variation can be achieved by changing the free length of the spring with the arrangement shown in FIG. 4.

Figure 2:
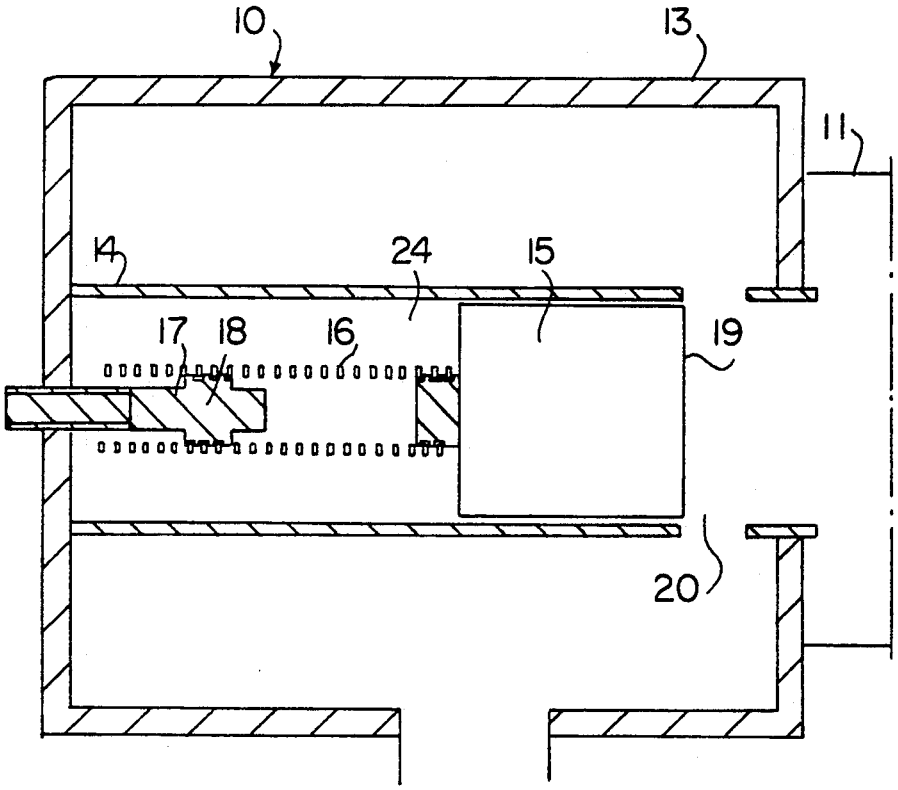
FIG. 2 is a view similar to what is shown in FIG. 1 but in an operational position.
Figure 3:
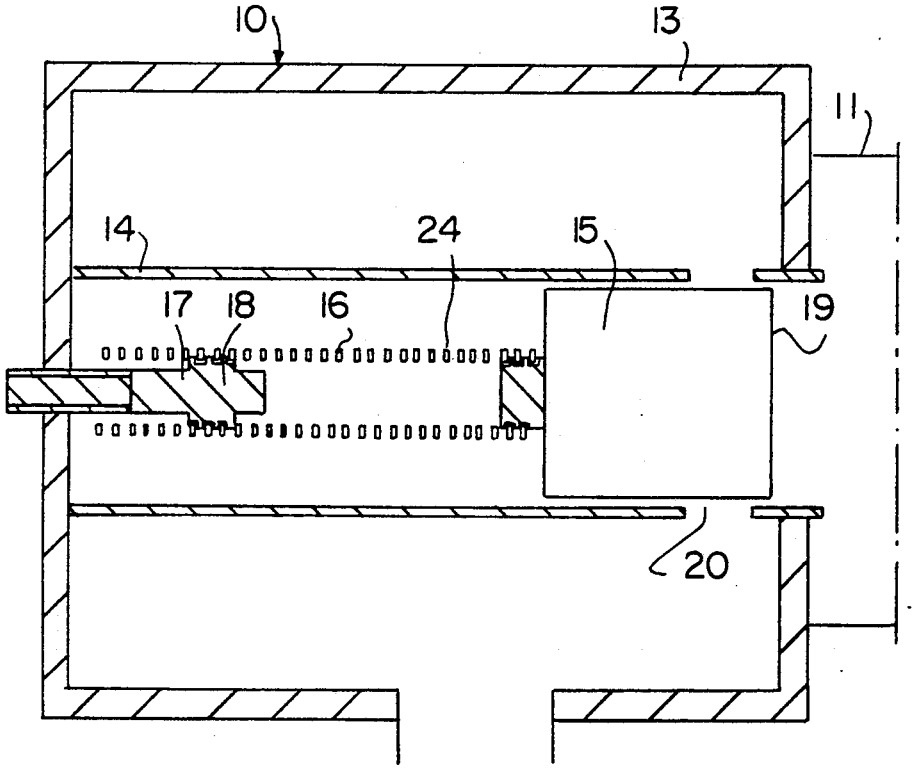
FIG. 3 is a view similar to FIG. 1 but in a different operational position.

FIG. 2 shows the position of the piston when there is a pressure above atmospheric pressure inside the resonator tube 11, and FIG. 3 shows the position of the piston when the pressure inside the resonator tube is below atmospheric pressure.

In the position shown in FIG. 3, the opening 20 is completely closed by the piston 15. However, due to the small radial play between the piston 15 and the tube 14, there is a small leakage of air from the surge tank 13 into the resonator tube. Due to the same circumstance there is also some leakage of air into the space behind the piston. Both leakages are undesirable and reduce the efficiency of the sound generation. The volume of the leakage is a function of the pressure inside the surge tank 13. Through the arrangement with the surrounding surge tank and due to the small pressure loss when the air passes through the opening 20, the pressure inside the surge tank 13 needs to be only slightly higher than the sound pressure amplitude inside the resonator close to the feeder. This circumstance will limit the leakage at the moment when the piston closes the opening 20. The leakage backwards will be small when the piston is given a relatively big axial length.

I claim:

1. In an air-driven, low-frequency sound generator with a positive feedback system, including, as a sound emitter, an open end tubulator resonator for generating standing, gas-borne sound waves which produce a varying gas pressure in the resonator and a feeder connected to one end of the resonator for regulating and supplying pressurized gas to the resonator from a source of pressurized gas and in which the feeder comprises a tube open at one end that communicates with the interior of the resonator and a reciprocable, resilient slide valve located in the tube that regulates the flow of pressurized gas from the feeder to the resonator while creating a modulated flow of gas to the resonator, the improvement comprising a surge tank surrounding said tube that is connectable to the source of pressurized gas, a piston slidably mounted in said tube and having a first end surface communicating with the interior of the resonator and spring means acting on an opposite end of said piston, said piston having a side surface between said ends and being moveable back and forth inside said tube under the competing influences of variations in the pressure inside the resonator and the force of the spring means and an opening in the tube controlled by the side surface of said piston that communicates the interior of the surge tank with the interior of the tube and the interior of the resonator, the side surface of said piston periodically opening and closing said opening as it moves back and forth in the tube to thereby modulate the flow of gas to the resonator.

2. The sound generator of claim 1, wherein the opening has two edges defining its width, said first end surface of the piston, when said piston is in a rest position, defining a gap of width ($\partial$) with the edge of the opening located closest to said one end of the resonator that is less than the width of the opening.

3. The sound generator of claim 2, wherein the spring means comprises a helical spring connected at one end to the piston and at its other end to a means for adjusting the free length of the spring.

4. The sound generator of claim 3, wherein the free length of the helical spring is adjustable without changing the width ($\partial$) of the gap when the piston is in the rest position.

* * * * *